United States Patent [19]

Mandel

[11] Patent Number: 4,826,015

[45] Date of Patent: May 2, 1989

[54] ROLLED MATERIAL HANDLING ARRANGEMENT

[76] Inventor: Ronald L. Mandel, 9115 Old State Rd., Evansville, Ind. 47711

[21] Appl. No.: 764,793

[22] Filed: Aug. 12, 1985

[51] Int. Cl.[4] ..... B65D 19/00

[52] U.S. Cl. ..... 206/597; 206/303; 206/386; 206/586; 206/453

[58] Field of Search ..... 206/303, 386, 387, 397, 206/586, 597, 453; 108/51.1, 51.3, 55.1, 55.5

[56] References Cited

U.S. PATENT DOCUMENTS

| | | | |
|---|---|---|---|
| 2,004,627 | 6/1935 | Hann | 206/453 |
| 2,065,649 | 12/1936 | Burke | 206/597 |
| 2,527,842 | 10/1950 | Mullaney | 206/397 |
| 3,104,085 | 9/1963 | Skladany | 206/597 |
| 3,331,496 | 7/1967 | Marsden et al. | 108/51.1 |
| 3,385,678 | 5/1968 | Sorenson | 206/597 |
| 3,472,363 | 10/1969 | Rustin, Jr. et al. | 206/597 |
| 3,645,387 | 2/1972 | Hunt | 206/453 |
| 3,785,482 | 1/1974 | Preston | 206/387 |
| 3,858,723 | 1/1975 | Weiss | 206/303 |
| 3,943,860 | 3/1976 | Brennan | 108/51.1 |
| 4,132,310 | 1/1979 | Dorsch | 206/386 |
| 4,317,517 | 3/1982 | Tisdale | 206/597 |
| 4,513,864 | 4/1985 | Liebel | 206/586 |

*Primary Examiner*—David T. Fidei
*Attorney, Agent, or Firm*—Warren D. Flackbert

[57] ABSTRACT

A rolled material handling arrangement characterized by at least a pair of flexible bases adapted to conform to the curvature of rolled sheet metal stock and support such for transport and/or storage. The bases each include downwardly extending anti-roll projections and a groove for receiving a tie strap which encircles the rolled stock and overlies a protective cover disposed around the outer diameter corner edge thereof. The arrangement permits on edge stock movement, i.e. along the flat surface of the sheet metal in contrast to the surface presented by the contiguous edges presented by successive layers of the roll.

2 Claims, 1 Drawing Sheet

ROLLED MATERIAL HANDLING ARRANGEMENT

As is known, the desire for optimum rolled material handling, as at the fabricating site and at the production site, i.e. where used at a manufacturing facility, is of considerable concern. Ready transporting to and from various locations, together with the absence of material damage, are necessary to maintain an effective production flow and, as well, unwanted costs to the user. Rolled sheet metal stock comes within the purview of the preceding needs.

The invention accomplishes the aforesaid purposes, i.e. permits effective movement of rolled sheet material, by providing a pair of readily adaptable supports for such. The supports, typically made from a plastic resin, are each effectively flexed into a position satisfying the rolled curvature of the flat metal surface, i.e. not the contiguous edges of the rolled sheet, and include downwardly extending anti-roll projections engaging the floor or other receiving area.

The instant arrangement includes a slotted portion in each support which serves to receive and/or position a band encircling a protective cover overlying a corner or outer edge of the rolled material, where the assembly is further completed by laterally encircling securement bands. The invention permits the ready storage of the rolled stock in an upright position, i.e. on the flat surface in contrast to the surface presented by the successive layers of rolled edges.

In any event, a better understanding of the present invention will become more apparent from the following description, taken in conjunction with the accompanying drawing, wherein FIG. 1 is a view in side elevation showing rolled sheet metal stock in a assembled relationship with a material handling arrangement in accordance with the teachings of the invention;

Figure 1:
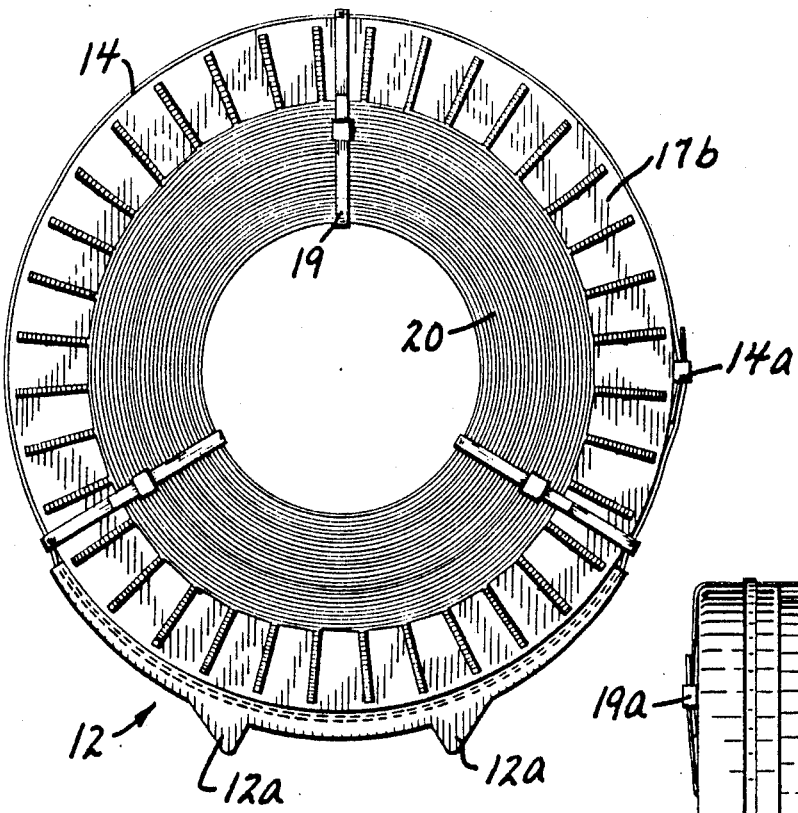

From the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
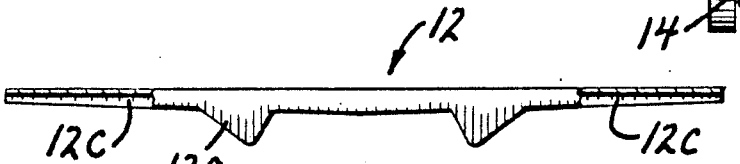
FIG. 3 is a side elevational view, partly in vertical section, of the rolled material handling arrangement herein, without the rolled sheet metal stock and before flexing into a use condition.
Figure 4:
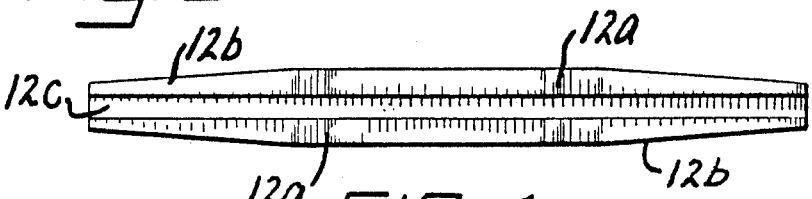
FIG. 4 is a bottom plan view of the invention, looking upwardly in FIG. 3; and, FIG. 5 is an end view of the invention, looking either from the right or from the left in FIG. 4.

Referring now to the figures, the rolled material handling arrangement of the invention is characterized by an elongated base member 12 which includes downwardly extending spaced apart anti-roll portions or feet 12*a* (see FIGS. 1 and 3) and, typically, tapers inwardly, in regions 12*b*, from portions 12*a* towards each end (see FIG. 4). The base member 12 is, importantly, flexible and, characteristically, formed from an extruded plastic resin. In any event, the base member 12 must be adaptable to flex from a non-use condition (FIG. 3) to a use condition (FIG. 1).

Figure 2:
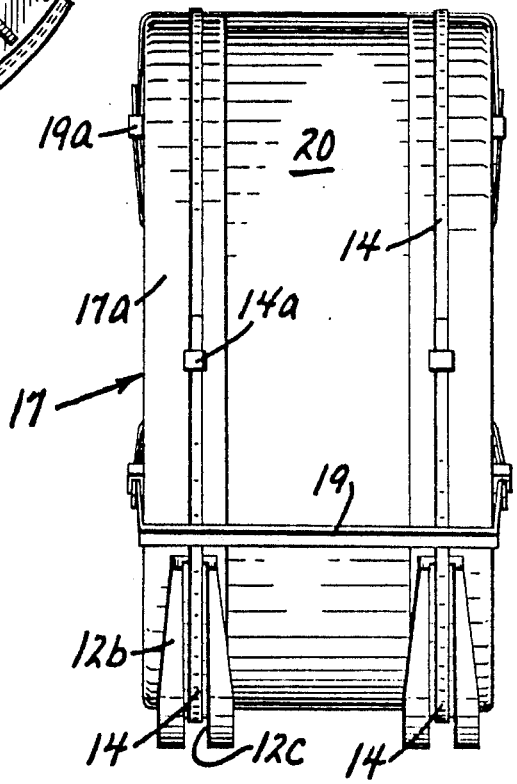
FIG. 2 is a view in end elevation of the instant invention, comparing to that of FIG. 1 and looking either from right to left or from left to right in such figure.
Figure 5:
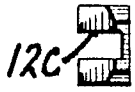

As particularly evident in FIGS. 2, 4 and 5, the base member 12 includes a longitudinally extending groove 12*c* which serves to receive and positively position a tie strap 14 (see FIG. 2), where the latter overlies a protective cover 17 on rolled sheet metal stock 20. Protective covers 17 are arranged around the outer diameter corners or edges of the stock 20, where each includes a continuous portion 17*a* on the flat surface of the stock 20 and a radially slitted portion 17*b* overlying the contiguous edges of the layers of rolled stock 20.

A conventional fastener 14*a* secures strap 14 into position, where the assembly, in use, is completed by laterally and radially extending straps 19, each also secured by a conventional fastener 19*a*. As evident, in FIGS. 1 and 2, straps 19 overlie the straps 14 after complete assembly.

The use of the rolled material handling arrangement presented herein is apparent from the drawing, where a pair of spaced apart base members 12 are involved (see FIG. 2). After the protective covers 17 are initially positioned on the rolled sheet stock 20 and the base members 12 flexed into a position which assumes the curvature of the rolled stock 20, the tie straps 14 are positioned and secured (at fasteners 14*a*). Thereafter, the straps 19 are caused to overlie the preceding (again see FIGS. 1 and 2).

The rolled sheet metal stock 20, because of the invention, can now be stored vertically, i.e. along the flat surface in contrast to the surface presented by the contiguous edges, where, moreover, the area between the downwardly extending anti-roll portions 12*a* of the base members 12 could be lowered to serve for additional load bearing. In any event, transporting and storage is simplified, and material/stock damage eliminated or, at least, minimized.

The rolled material handling arrangement described hereabove is susceptible to various changes within the invention including, for example, in proportioning, material choice, and the like. Thus, the peceding should be considered illustrative and not as limiting the scope of the following claims:

I claim:

1. A rolled material handling arrangement comprising a pair of spaced apart longitudinal base members adapted to receive and support the flat surface of rolled sheet metal stock, each of said spaced apart longitudinal base members including downwardly extending projections serving a support and an anti-roll relationship and spacing the area therebetween with respect to a load receiving surface in a use condition, where said longitudinal base members are flexible in a conforming relationship with the curvature of said rolled sheet metal stock when in said use condition, and where said longitudinal base members each include a downwardly facing longitudinal groove receiving a tie strap encircling said rolled sheet metal stock and overlying a protective cover disposed around the outer diameter edge of said rolled sheet metal stock.

2. The rolled material handling arrangement of claim 1 where other tie straps radially encircle and overlie said tie strap, said protective cover, and portions of said rolled sheet metal stock.

* * * * *